US008955839B2

(12) United States Patent
Oyama et al.

(10) Patent No.: US 8,955,839 B2
(45) Date of Patent: Feb. 17, 2015

(54) PAPER FEED APPARATUS AND IMAGE FORMING SYSTEM

(71) Applicant: Konica Minolta , Inc., Tokyo (JP)

(72) Inventors: Hiroshi Oyama, Hino (JP); Kenji Izumiya, Hachioji (JP); Kiyoto Kojima, Hachioji (JP); Atsushi Takahashi, Akishima (JP)

(73) Assignee: Konica Minolta, Inc., Tokyo (JP)

( * ) Notice: Subject to any disclaimer, the term of this patent is extended or adjusted under 35 U.S.C. 154(b) by 0 days.

(21) Appl. No.: 14/083,484

(22) Filed: Nov. 19, 2013

(65) Prior Publication Data

US 2014/0138899 A1 May 22, 2014

(30) Foreign Application Priority Data

Nov. 20, 2012 (JP) ..... 2012-253899

(51) Int. Cl.

| | |
|---|---|
| ***B65H 7/02*** | (2006.01) |
| ***B65H 9/04*** | (2006.01) |
| ***B65H 3/44*** | (2006.01) |
| ***B65H 5/26*** | (2006.01) |

(52) U.S. Cl.

CPC ..... *B65H 5/26* (2013.01)
USPC ..... 271/242; 271/226; 271/229; 271/9.02

(58) Field of Classification Search

USPC ..... 271/9.01–9.13, 242–246, 226–229
See application file for complete search history.

(56) References Cited

U.S. PATENT DOCUMENTS

| | | | | |
|---|---|---|---|---|
| 4,548,394 | A * | 10/1985 | Koyama et al. | 271/9.11 |
| 5,289,236 | A * | 2/1994 | Yoshino | 399/86 |
| 5,299,795 | A * | 4/1994 | Miyake | 271/9.02 |
| 5,327,207 | A * | 7/1994 | Otake et al. | 399/364 |
| 5,383,654 | A * | 1/1995 | Iseda | 271/9.05 |
| 5,482,265 | A * | 1/1996 | Nakazato et al. | 271/242 |
| 5,775,690 | A * | 7/1998 | Quesnel et al. | 271/242 |
| 5,963,755 | A * | 10/1999 | Ueda et al. | 399/23 |

(Continued)

FOREIGN PATENT DOCUMENTS

| | | |
|---|---|---|
| JP | 07-144796 | 6/1995 |
| JP | 09-240856 A | 9/1997 |

(Continued)

OTHER PUBLICATIONS

Japanese Office Action, Rejection Notice, Patent Application No. 2012-253899, Drafting Date: Nov. 28, 2014. Dispatch Date: Dec. 2, 2014 and English translation thereof (total of 6 pages).

*Primary Examiner* — Patrick Cicchino
(74) *Attorney, Agent, or Firm* — Lucas & Mercanti, LLP

(57) ABSTRACT

A paper feed apparatus is capable of correcting the skew of a sheet irrespective of a differential conveyance distance. The paper feed apparatus is provided with a first large volume paper feed apparatus 100A having a control unit 130 which performs first correction control to correct the skew of a sheet by controlling a first conveyance unit 110 and forming a loop of the sheet P before a paper stop rollers 110*d*, and also performs second correction control to correct the skew of a sheet by controlling a second conveyance unit 120 and forming a loop of the sheet before a paper stop rollers 110*d*. In this case, the control unit 130 controls the first conveyance unit 110 and the second conveyance unit 120 in order that the skew correcting ability of the second correction control becomes greater than the skew correcting ability of the first correction control.

8 Claims, 5 Drawing Sheets

(56) References Cited

U.S. PATENT DOCUMENTS

| | | | | |
|---|---|---|---|---|
| 6,148,172 | A * | 11/2000 | Kanda et al. | 399/391 |
| 6,263,186 | B1 * | 7/2001 | Okamoto et al. | 399/388 |
| 6,674,983 | B2 * | 1/2004 | Enomoto et al. | 399/124 |
| 8,641,043 | B2 * | 2/2014 | Masuda | 271/264 |
| 2009/0302528 | A1 * | 12/2009 | Ubayashi | 271/229 |

FOREIGN PATENT DOCUMENTS

| | | |
|---|---|---|
| JP | 11-079466 | 3/1999 |
| JP | 2010-024036 | 2/2010 |
| JP | 2012-086929 | 5/2012 |

* cited by examiner

PAPER FEED APPARATUS AND IMAGE FORMING SYSTEM

CROSS-REFERENCE TO RELATED APPLICATIONS

The present application claims priority under 35 U.S.C. §119 to Japanese Patent Application No. P2012-253899, filed Nov. 20, 2012. The contents of this application are herein incorporated by reference in their entirety.

FIELD OF THE INVENTION

The present invention relates to a paper feed apparatus and an image forming system.

DESCRIPTION OF THE RELATED ART

In recent years, image forming systems are known which include a plurality of apparatuses connected in series from the upstream side to the downstream side for the purpose of effectively forming images on paper and performing various treatments associated with the image formation. For example, a known image forming system of this type is provided with a paper feed apparatus, an image forming apparatus for forming images on sheets, and a finisher for performing post-printing processes which are connected in series. Also, another configuration is known which includes a plurality of paper feed apparatuses connected in series in the upstream side for the purpose of feeding multiple types of paper sheets in large numbers.

The paper feed apparatus is provided with a paper tray for storing sheets and a first conveyance unit for conveying sheets fed from the paper tray, and feeds the sheets to an apparatus located in the downstream side. Also, taking into consideration the series connection of apparatuses as described above, the paper feed apparatus is provided further with a second conveyance unit in addition to the first conveyance unit. The second conveyance unit is configured to receive a sheet fed from another paper feed apparatus connected in the upstream side of the own apparatus, and transfers the sheet to a further paper feed apparatus connected in the downstream side of the own apparatus.

Incidentally, for example, as disclosed in Japanese Patent Published Application No. H09-240856, an image forming system is provided with a paper feed mechanism capable of continuously conveying same size sheets from an optional paper feed cassette and a body paper feed cassette respectively. This image forming system consists of an image forming apparatus body mounted on an optional paper feeding unit provided with paper feed cassettes. The image forming apparatus body includes a cassette leading unit which is loaded with a body side paper feed cassette and provided with a paper feed unit from which a feeding conveying rout is formed through paper stop rollers. The optional paper feeding unit is provided with a feeding conveying route which is coupled with the body side feeding conveying route in the image forming apparatus body side. In this case, the feeding speed in the feeding conveying route of the optional paper feeding unit is determined to be proportional to the conveyance path length from paper feed rollers of the optional paper feeding unit to the paper stop rollers.

Meanwhile, when comparing a sheet conveyed by the first conveyance unit with a sheet conveyed by the second conveyance unit, the sheet conveyed by the second conveyance unit is conveyed a longer distance because of being transferred from the apparatus located in the upstream side. For this reason, the sheet conveyed by the second conveyance unit tends to be obliquely conveyed, i.e., cause media skew.

The present invention has been made in order to solve the problem as described above. It is an object of the present invention therefore to appropriately correct the skew of a sheet irrespective of the differential conveyance distance in a paper feed apparatus.

SUMMARY OF THE INVENTION

To achieve at least one of the above-mentioned objects, a paper feed apparatus comprises: a paper tray configured to store sheets; a paper stop unit configured to transfer a sheet to an apparatus connected in the downstream side of the paper feed apparatus with a predetermined timing; a first conveyance unit configured to convey a sheet fed from the paper tray to the paper stop unit; a second conveyance unit configured to receive a sheet from an apparatus connected in the upstream side of the paper feed apparatus and convey this paper to the paper stop unit; and a control unit configured to perform first correction control for controlling the first conveyance unit to correct the skew of a sheet by forming a loop of the sheet between the paper stop unit and the first conveyance unit, and second correction control for controlling the second conveyance unit to correct the skew of a sheet by forming a loop of the sheet between the paper stop unit and the second conveyance unit. Particularly, the control unit performs the first correction control and the second correction control in order that the skew correcting ability of the second correction control is greater than the skew correcting ability of the first correction control.

In a preferred embodiment, the control unit sets the conveyance linear speed of a sheet through the second conveyance unit for the second correction control slower than the conveyance linear speed of a sheet through the first conveyance unit for the first correction control.

Also, in a preferred embodiment, the control unit sets the loop amount of a sheet for the second correction control greater than the loop amount of a sheet for the first correction control.

Furthermore, in a preferred embodiment, each of the first conveyance unit and the second conveyance unit comprising: a loop roller located in the upstream side of a paper stop roller which functions as the paper stop unit, and configured to form a loop between the loop roller and the paper stop roller; one or more conveyance roller located in the upstream side of the loop roller.

Furthermore, in a preferred embodiment, the one or more conveyance roller located in the upstream side of the loop roller is configured to switch between a pressure engaged state and a disengaged state, wherein when forming a loop of a sheet with the loop roller, the control unit switches the one or more conveyance roller to the disengaged state.

Furthermore, in a preferred embodiment, the loop roller is separated into halves which are located respectively corresponding to the opposite edges of a sheet in the direction perpendicular to the transfer direction of the sheet, wherein the control unit performs the second correction control in order that the halves of the loop roller are halted with different timings in accordance with the skew amount of the sheet.

DETAILED DESCRIPTION OF THE PREFERRED EMBODIMENT

First Embodiment

Figure 1:
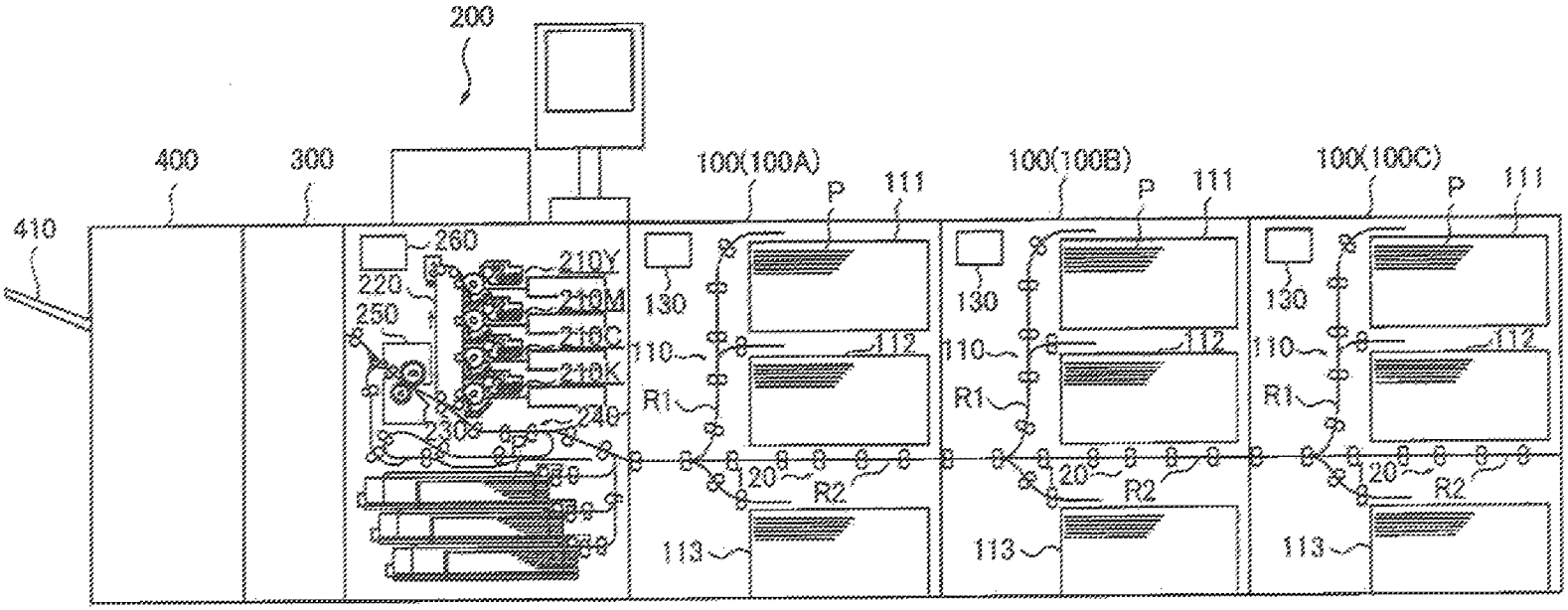
FIG. 1 is a view for schematically showing the configuration of an image forming system in accordance with a first embodiment.

FIG. 1 is a view for schematically showing the configuration of an image forming system in accordance with the present embodiment. The image forming system includes a plurality of apparatuses which are connected in series from the upstream side to the downstream side to perform various treatments with sheets P respectively associated with the image formation. Particularly, the image forming system of the present embodiment includes three large volume paper feed apparatuses 100, an image forming apparatus 200, a relay device 300 and a finisher 400 connected in series.

The large volume paper feed apparatus 100 is a device for accumulating and storing a large volume of sheets P and feeding the image forming apparatus 200 with the sheets P. This large volume paper feed apparatus 100 is provided with a first conveyance unit 110, a second conveyance unit 120 and a control unit 130.

The first conveyance unit 110 is provided with a plurality of paper trays, e.g., three paper trays 111, 112 and 113, and a paper conveying mechanism consisting of a plurality of conveyance members, guide members and so forth. Each of the paper trays 111, 112 and 113 is capable of storing various sizes/types of sheets P respectively. The paper conveying mechanism extracts sheets P one by one from one of the paper trays 111, 112 and 113 in accordance with user's selection and conveys the sheets P through a first conveying route R1. By this configuration, the first conveyance unit 110 feeds sheets P stored in own apparatus to an apparatus connected in the downstream side. Each conveyance member can be formed with a pair of rollers. Alternatively, each conveyance can be generally formed with a combination of a pair of belts, a combination of a belt and a roller, or any other combination of a pair of rotary members.

The second conveyance unit 120 is provided with a paper conveying mechanism consisting of a plurality of conveyance members, guide members and so forth. This paper conveying mechanism is connected to another large volume paper feed apparatus 100 in the upstream side, and capable of conveying a sheet P which is fed from this another large volume paper feed apparatus 100 or a further large volume paper feed apparatus 100 which may be connected in a further upstream side along the second conveying route R2. By this configuration, the second conveyance unit 120 transfers the sheet P received from the upstream side of own apparatus to an apparatus connected in the downstream side. Each conveyance member can be formed with a pair of rollers. Alternatively, each conveyance can be generally formed with a combination of a pair of belts, a combination of a belt and a roller, or any other combination of a pair of rotary members.

The control unit 130 is a computer provided with a CPU, memories seen as a ROM and a RAM, a nonvolatile memory serving as an auxiliary storage device, and a communication I/F which are connected to each other through a bus. The control unit 130 conveys sheets P to an apparatus connected in the downstream side by controlling the first conveyance unit 110 and the second conveyance unit 120.

In this specification, when a particular one of the three large volume paper feed apparatuses 100 is distinguished from the others, the first to the third large volume paper feed apparatus counted upstream from the image forming apparatus 200 are referred to as "the first large volume paper feed apparatus 100A", "the second large volume paper feed apparatus 100B", and "the third large volume paper feed apparatus 100C".

The image forming apparatus 200 is an electrophotographic image forming apparatus such as a copying machine. The image forming apparatus 200 is capable of forming images (toner images) on sheets P fed from any one of the large volume paper feed units 100 or on sheets P stored in the image forming apparatus 200 itself. The image forming apparatus 200 consists, for example, mainly of four image forming units 210Y, 210M, 210C and 210K, an intermediate transfer belt 220, a second transfer roller 230, a paper conveying unit 240, a fixing unit 250, and a control unit 260.

The four image forming units 210Y, 210M, 210C and 210K are an image forming unit 210Y for forming yellow (Y) images, an image forming unit 210M for forming magenta (M) images, an image forming unit 210C for forming cyan (C) color images, and an image forming unit 210K for forming black (K) images. The four image forming units 210Y, 210M, 210C and 210K are vertically arranged in contact with an intermediate transfer belt 220 as an intermediate transfer member to form full-color images.

The images formed by the image forming units 210Y, 210M, 210C and 210K are successively transferred to a predetermined location of the intermediate transfer belt 220 and superimposed as color components respectively to form a full-color image. The full-color image transferred to the intermediate transfer belt 220 is then transferred to a sheet P, which is conveyed by the paper conveying unit 240 with a predetermined timing, through the second transfer roller 230 which is a transfer member in the form of a roller.

The paper conveying unit 240 is provided with one or more paper tray, and a paper conveying mechanism consisting of a plurality of conveyance members, guide members and so forth. The paper conveying unit 240 conveys a sheet P stored in the paper tray or received from the large volume paper feed apparatus 100 along a predetermined conveying route in order to transfer the sheet P to an apparatus connected in the downstream side.

For example, a plurality of conveyance members are provided on the conveying route which is located in the upstream side of the transfer site where an image is formed on a sheet P. Each conveyance member is composed, for example, of a pair of rollers. A sheet P conveyed in the system reaches the paper stop rollers after being transferred by a plurality of conveyance roller pairs. These paper stop rollers nave a function of conveying a sheet and also a function of adjusting the timing of conveying a sheet P, as a paper stop unit, when an image is formed on (transferred to) the sheet P. The sheet P can therefore be conveyed to the transfer site by the paper stop rollers in synchronization with a toner image. After transferring the image, the sheet P is conveyed to the fixing unit 250 together with the image transferred on the sheet P.

The fixing unit 250 consists of a heat roller and a pressure roller. The heat roller is provided with a built-in heat source (not shown) with which the heat roller can be controlled at a predetermined temperature. When the sheet P is passed through a nip site located between the neat roller and the pressure roller during the conveyance of the sheet P, the image transferred to the sheet P is heated and pressed, and then fixed to the sheet P. After the fixing treatment with the fixing unit 250, the sheet P is conveyed to the relay device 300.

The control unit 250 is responsible for integrally controlling the image forming apparatus 200 and can be implemented with a computer provided with a CPU, memories such as a ROM and a RAM, an HDD (Hard Disk Drive) as an auxiliary storage device, and a communication I/F, which are connected with each other through a bus. The control unit 260 forms an image on a sheet P by controlling the units of the image forming apparatus (for example, the image forming units 210Y, 210M, 210C, 210K, the paper conveying unit 240, the fixing unit 250 and so forth).

The relay device 300 is located in the downstream side of the image forming apparatus 200 and conveys the sheet P, which is discharged from the image forming apparatus 200, to the finisher 400. When conveying a sheet P, this relay device 300 can correct a curl of the sheet P and/or reverse the front and back sides of the sheet P, if needed.

The finisher 400 is a device provided for receiving the sheet P fed from the relay device 300 and performing a post-printing process for the sheet P. The post-printing process is for example a folding process of folding a sheet P in various ways, a punching process of punching a sheet P, a bookbinding-process of folding, saddle-stitching and trimming a plurality of sheets P, a staple process of stapling a plurality of sheets P together, or the like. The finisher 400 performs a predetermined post-printing process with a sheet P, and discharges the sheet P, which has been subjected to the post-printing process, to a laterally-located, catch tray 410.

Figure 2:
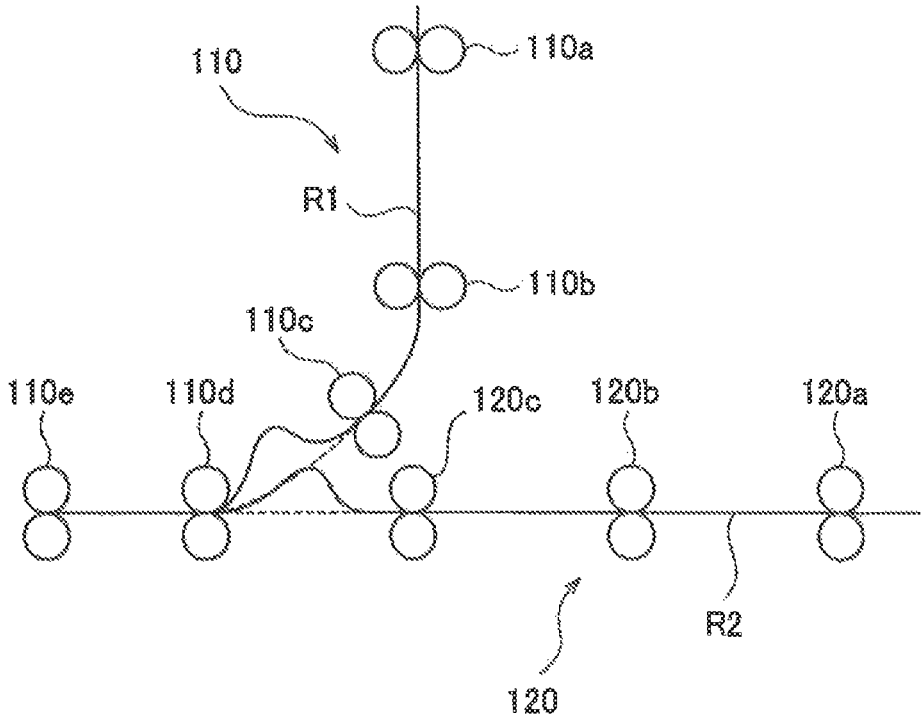
FIG. 2 is an explanatory view for schematically showing the main structures of a first conveyance unit and a second conveyance unit of the image forming system shown in FIG. 1.

In this case, one of the characteristic features of the present, embodiment is that, before feeding a sheet P to the image forming apparatus 200, the first large volume paper feed apparatus 100A, which is located immediately adjacent to the image forming apparatus 200 in the upstream side, performs correction control to correct a skew or the sheet P, i. e., angular misalignment of the sheet P. FIG. 2 is an explanatory view for schematically showing the main structures of the first conveyance unit 110 and the second conveyance unit 120. Incidentally, the conveying route for receiving sheets P from the most lowest paper tray 113 is omitted from the same figure for the sake of clarity in explanation.

When receiving a sheet P from the upper paper tray 111 or the middle paper tray 112, the first conveyance unit 110 successively conveys the sheet P along the first conveying route R1 through a plurality of pairs of conveyance rollers 110*a* and 110*b* and a pair of loop rollers 110*c*, which are located from the upstream side to the downstream side. The sheet P conveyed by the loop rollers 110*c* collides with a pair of paper stop rollers 110*d*, which are not rotated in a halting state, to form a loop of the sheet P (slack in the form of a loop) by continuing rotation of the loop rollers 110*c*. The skew of the sheet P can be corrected by this loop formation (first correction control). Likewise, a sheet P fed from the lower paper tray 113 is successively conveyed by conveyance rollers and loop rollers, and collides with the paper stop rollers 110*d*, which are not rotated in a halting state. Then, a loop of the sheet P (slack in the form of a loop) is formed by continuing rotation of the loop rollers to correct the skew of the sheet P.

On the other hand, when receiving a sheet P from the apparatus located in the upstream side, the second conveyance unit 120 successively conveys the sheet P along the second conveying route R2 through a plurality of pairs of conveyance rollers 120*a* and 120*b* and a pair of loop rollers 120*c*, which are located from the upstream side to the downstream side. The sheet P conveyed by the loop rollers 120*c* collides with a pair of paper stop rollers 110*d*, which are not rotated in a halting state, to form a loop of the sheet P (slack in the form of a loop) by continuing rotation of the loop rollers 120*c*. The skew of the sheet P can be corrected by this loop formation (second correction control).

Then, the paper stop rollers 110*d* resume rotation with a predetermined timing to start again conveying the sheet P, which has been conveyed along the first conveying route R1 or the second conveying route R2, and discharge the sheet P to the apparatus located in the downstream side through discharging rollers 110*e*. Meanwhile, in the case of the present embodiment, the first conveying route R1 and the second conveying route R2 share the same route in the downstream side of the paper stop rollers 110*d*. The paper stop rollers 110*d* of the present embodiment as described above serve as part of the first conveyance unit 110 or the second conveyance unit 120 to convey a sheet, and also serve as a paper stop unit to transfer the sheet P to the image forming apparatus 200 with a predetermined timing.

Figure 3A:
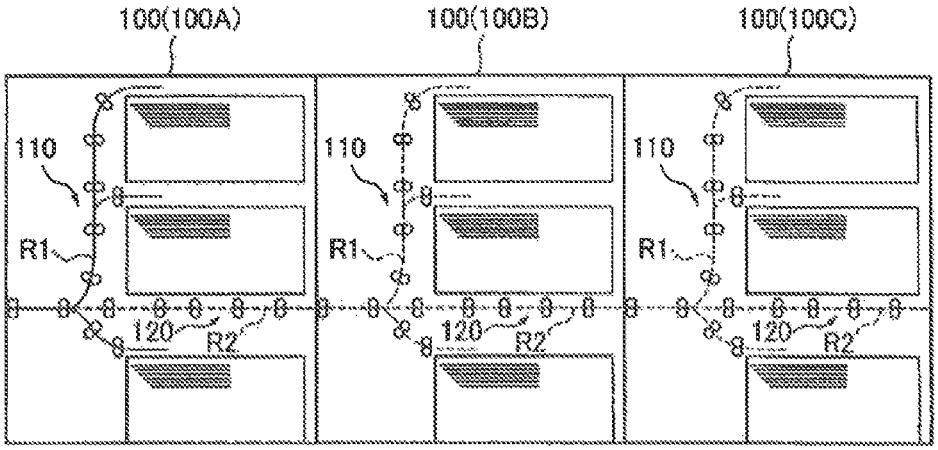
FIGS. 3A and 3B are an explanatory view for schematically showing the conveying routes of sheets in the image forming system shown in FIG. 1.
Figure 3B:
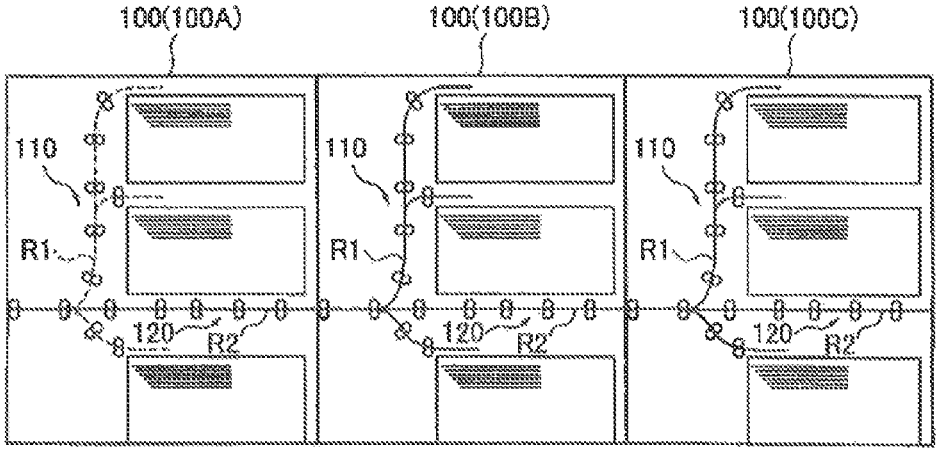
Figure 4:
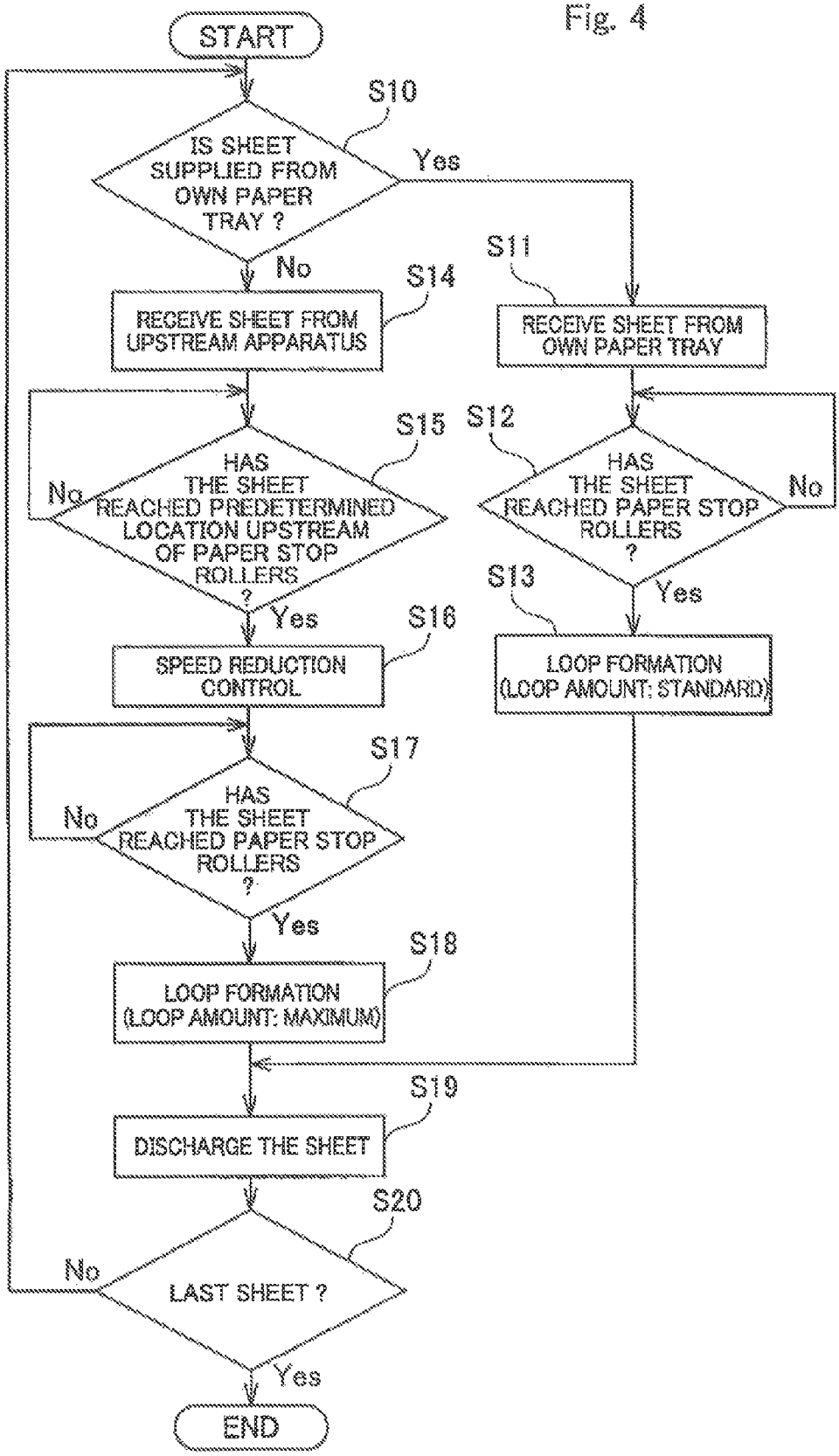
FIG. 4 is a flow chart, for showing the procedure of conveying sheets by the control unit of a first large volume paper feed apparatus in the image forming system shown in FIG. 1.

FIGS. 3A and 3B are explanatory views for schematically showing the conveying routes of sheets P, and FIG. 4 is a flow chart for showing the operation of the image forming system according to the present embodiment, particularly, the procedure of conveying a sheet P by the control unit 130 of the first large volume paper feed apparatus 100A. The process based on this flow chart is called when a job is input, and performed by the control unit 130 of the first large volume paper feed apparatus 100A.

In step 10 (S10), the control unit 130 determines whether or not a sheet P is fed from the paper tray 111, 112 or 113 of own apparatus. If the sheet P is fed from the paper tray 111, 112 or 113 of own apparatus, the first conveyance unit 110 (the first conveying route R1) is used to convey the sheet P from the first large volume paper feed apparatus 100A (refer to FIG. 3A). Conversely, if the sheet P is fed from a paper tray other than the paper tray 111, 112 or 113 of own apparatus. i.e., from the paper tray 111, 112 or 113 of the second large volume paper feed apparatus 100B or the third large volume paper feed apparatus 100C in the upstream side of the first large volume paper feed apparatus 100A, the second conveyance unit. 120 (the second conveying route R2) is used to convey the sheet P from the first large volume paper feed apparatus 100A (refer to FIG. 3B).

In the case of the present embodiment, the correction control scheme is changed in correspondence with the conveying route used in the first large volume paper feed apparatus 100A so that the conveying route is determined in step 10. If the determination is in the affirmative in step 10, i.e., if the sheet P is fed from the paper tray 111, 112 or 113 of own apparatus, the process proceeds to step 11 (S11). Conversely, if the determination is in the negative in step 10, i.e., if the sheet P is fed from a paper tray other than the paper tray 111, 112 or 113 of own apparatus, the process proceeds to step 14 (S14) to be described later.

In step 11, the control unit 130 controls the first conveyance unit 110 to feed a sheet P from a predetermined paper tray 111, 112 or 113 in correspondence with a job request, and conveys the sheet P along the first conveying route R1. In this stage, the paper stop rollers 110*d* are controlled to halt its rotation.

In step 12 (S12), the control unit 130 refers to a defection signal or the like output from a sheet sensor (not shown in the figure) located on the first conveying route R1 to determine whether or not the leading edge of the sheet P has reached the paper stop rollers 110*d*. If the determination is in the affirmative in step 12, i.e., if the leading edge of the sheet P has reached the paper stop rollers 110*d*, the process proceeds to step 13 (S13). On the other hand, if the determination is in the negative in step 12, i.e., if the leading edge of the sheet P has not reached the paper stop rollers 110*d* yet, this step 12 is repeated.

In step 13 (S13), the control unit 130 forms a loop of the sheet P (slack in the form of a loop) by having the sheet collide with the paper stop rollers 110*d*, which are not rotated in a halting state, and continuing rotation of the loop rollers 120*c*. A standard value of the loop amount to be formed of a sheet P is determined in accordance with the type of the sheet P (size and/or paper density). The loop of the sheet P can be formed corresponding to the standard value by adjusting the period in which rotation of the loop rollers 120*c* is halted in accordance with the conveyance linear speed of the sheet P. The skew of the sheet P can be corrected by this loop formation (first correction control).

On the other hand, after receiving a sheet P from the second large volume paper feed apparatus 100B, the control unit 130 conveys the sheet P along the second conveying route R2 in step 14 by controlling the second conveyance unit 120. In this stage, the paper stop rollers 110*d* are controlled to halt its rotation.

In step 15 (S15), the control unit 130 refers to a detection signal or the like output from a sheet sensor (not shown in the figure) located on the second conveying route R2 to determine whether or not the leading edge of the sheet P has reached a predetermined location in the upstream side of the paper stop rollers 110*d*. If the determination is in the affirmative in step 15, i.e., if the leading edge of the sheet P has reached the predetermined location, the process proceeds to step 16 (816). On the other hand, if the determination is in the negative in step 15, i. e., if the leading edge of the sheet P has not reached the predetermined location yet, this step 15 is repeated.

In step 16, the control unit 130 performs speed reduction control to reduce the conveyance linear speed of the sheet P to a speed lower than a standard speed by controlling the second conveyance unit 120. The standard speed corresponds to the conveyance linear speed of a sheet P which is set up in the first conveyance unit 110 and the second conveyance unit 120 and predetermined for each type of sheet P. On the other hand, from the view point of securing a loop formation time as described below, a speed reduction amount is set to an appropriate value which is determined in advance through experiments and simulations.

In step 17 (S17), the control unit 130 refers to a detection signal or the like output from a sheet sensor (not shown in the figure) located on the first conveying route R1 to determine whether or not the leading edge of the sheet P has reached the paper stop rollers 110*d*. If the determination is in the affirmative in step 17, i.e., if the leading edge of the sheet P has reached the paper stop rollers 110*d*, the process proceeds to step 18 (S18). On the other hand, if the determination is in the negative in step 18, i.e., it the leading edge of the sheet P has not reached the paper stop rollers 110*d* yet, this step 17 is repeated.

In step 18 (S18), the control unit 130 forms a loop of the sheet P (slack in the form of a loop) by having the sheet collide with the paper stop rollers 110*d*, which are not rotated in a halting state, and continuing rotation of the loop rollers 120*c*. The loop amount to be formed of a sheet P is determined to be a predetermined maximum value, i.e., a value larger than the standard value which is set up in accordance with the type of the sheet P (size and/or paper density). The control unit 130 forms a loop of the sheet P corresponding to the maximum value by adjusting the period in which rotation of the loop rollers 120*c* is halted in accordance with the conveyance linear speed of the sheet P. The skew of the sheet P can be corrected by this loop formation (second correction control).

In step 19 (S19), the control unit 130 starts rotation of the paper stop rollers 110*d* synchronously with a predetermined timing when conveying the sheet P to the image forming apparatus 200. When the conveyance of the sheet P is thereby resumed, the sheet P is discharged to the image forming apparatus 200 through the discharging rollers 110*e*.

In step 20 (S20), the control unit 130 determines whether or not the sheet P just discharged is the last sheet of the print job. If the determination is affirmative in step 20, i.e., if the sheet P just discharged is the last sheet, this routine ends. Contrary to this, if the determination is negative in step 20, i. e., if the sheet P just discharged is not the last sheet, the process is returned to step 10.

In the case of the present embodiment, as described above, the control unit 130 of the first large volume paper feed apparatus 100A performs the first correction control to correct the skew of a sheet P by controlling the first conveyance unit 110 and forming a loop of the sheet P between the loop rollers 110*c* and the paper stop rollers 110*d*. On the other hand, this control unit 130 performs the second correction control to correct the skew of a sheet P by controlling the second conveyance unit 120 and forming a loop of the sheet P between the loop rollers 120*c* and the paper stop rollers 110*d*. Particularly, in this case, the control-unit 130 controls the first conveyance unit 110 and the second conveyance unit 120 in order that the skew correcting ability of the second correction control becomes greater than the skew correcting ability of the first correction control.

This is because a sheet P conveyed from another apparatus in the upstream side tends to have a greater skew than a sheet P conveyed from the paper tray 111, 112 or 113 in own apparatus. It is therefore possible to appropriately correct the skew of a sheet P by making the skew correcting ability of the second correction control greater than the skew correcting ability of the first correction control. By this configuration, the skew of a sheet P can be appropriately corrected irrespective of the differential conveyance distance.

In the case of the present embodiment, the control unit 130 sets the conveyance linear speed of a sheet P through the second conveyance unit 120 for the second correction control slower than the conveyance linear speed of a sheet P through the first conveyance unit 110 for the first correction control.

The longer the time for forming a loop, the greater the skew correcting ability becomes. On the other hand, the slower the conveyance linear speed of a sheet P, the longer the time for forming a loop can be ensured. It is therefore possible to make the skew correcting ability of the second correction control greater than the skew correcting ability of the first correction control by setting the conveyance linear speed through the second conveyance unit 120 slower than the conveyance linear speed of a sheet P through the first conveyance unit 110.

Furthermore, in the case of the present embodiment, the control unit 130 sets the loop amount of a sheet P for the second correction control greater than the loop amount of a sheet P for the first correction control.

The larger the loop amount becomes, the greater the skew correcting ability becomes. It is therefore possible to make the skew correcting ability of the second correction control greater than the skew correcting ability of the first correction control by setting the loop amount of a sheet P for the second correction control greater than the loop amount of a sheet P for the first correction control.

Meanwhile, while both the linear speed and the loop amount are controlled in the case of the present embodiment, it is possible to only one of them can be controlled for the same purpose.

Second Embodiment

The image forming system of the second embodiment differs from that of the first embodiment in the control method of correcting the skew of a sheet P. Meanwhile, the second embodiment will be explained mainly with respect to the differences from the first embodiment without repeating redundant description.

Figure 5:
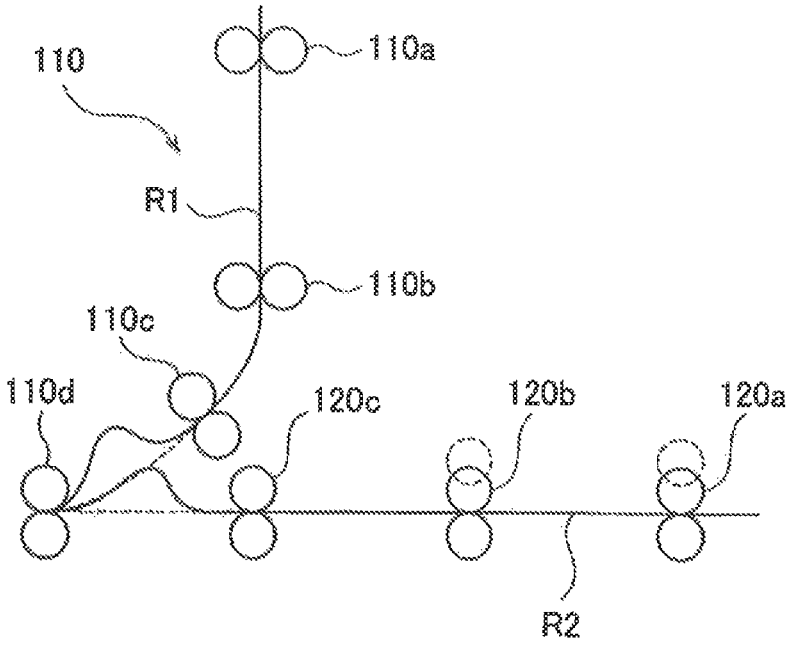
FIG. 5 is an explanatory view for schematically showing the main structures of a first conveyance unit and a second conveyance unit of an image forming system in accordance with a second embodiment.

Specifically speaking, as illustrated in FIG. 5, each pair of the conveyance rollers 120*a* and 120*b* located on the second conveying route R2 are provided in order to switch between a pressure engaged state and a disengaged state. In this case, the control unit 130 switches each pair of the conveyance rollers 120*a* and 120*b* located in the upstream side of the loop rollers 120*c* from the pressure engaged state to the disengaged state, before the leading edge of a sheet P reaches the paper stop rollers 110*d*. By this control, the sheet P is conveyed only by the loop rollers 120*c* after the conveyance rollers 120*a* and 120*b* are switched to the disengaged state.

Figure 6:
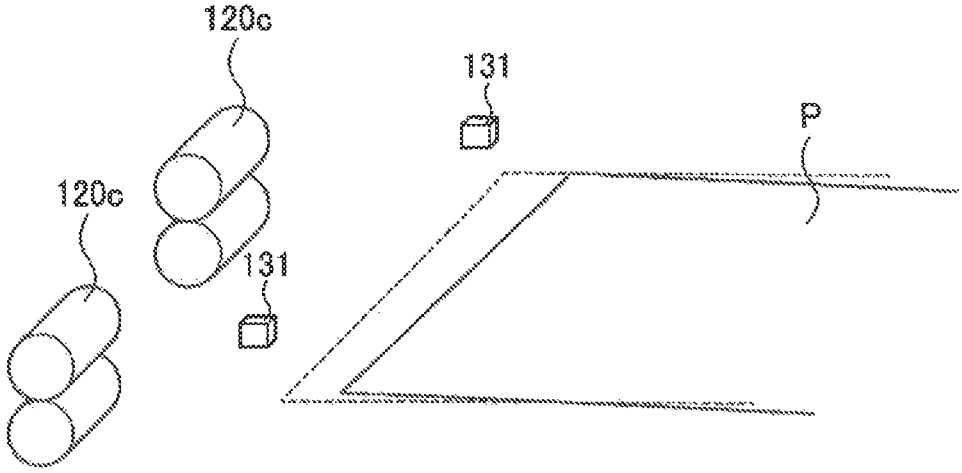
FIG. 6 is an explanatory view for schematically showing the loop rollers of the second conveyance unit in accordance with the second embodiment.

On the other hand, as illustrated in FIG. 6, each of the loop rollers 120*c* is separated into right and left halves which are located respectively corresponding to both the right and left edges of the sheet P in the direction perpendicular to the transfer direction of the sheet P. The right and left halves of the loop roller 120*c* can be driven independent from each other. Furthermore, in the upstream side of the loop rollers 120*c*, a pair of sheet detection sensors 131 are located corresponding to the right and left halves respectively. The control unit 130 can detect the skew amount of a sheet P with reference to the timing difference between the pair of sheet detection sensors 131 when detecting the sheet.

When the sheet P is not skewed, the control unit 130 forms a loop of the sheet P by halting the right and left halves of the loop rollers 120*c*. On the other hand, when the sheet P is skewed, the control unit 130 forms a loop of the sheet P by first halting one of the right and left halves of each loop roller 120*c* corresponding to one of the sheet detection sensors 131 which first detects the sheet P, and then halting the other half which is detected later by the other sheet detection sensor 131. The time difference between the right and left halves when halting the right and left halves of the loop rollers 120*c* can be determined in accordance with the skew amount of the sheet P.

In the case of the present embodiment, as described above, the control unit 130 of the first large volume paper feed apparatus 100A switches the conveyance rollers 120*a* and 120*b* to the disengaged state when forming a loop of a sheet P by the loop rollers 120*c*.

By this configuration, when a loop is formed of a sheet P by the loop rollers 120*c* with the conveyance rollers 120*a* and 120*b* being disengaged in the upstream side, it becomes easy to correct the skew of the sheet P since the sheet P is not restricted. Thereby, the skew of a sheet P can be appropriately corrected irrespective of the differential conveyance distance.

Furthermore, in the case of the present embodiment, the control unit 130 performs the second correction control in order that the right and left halves of the loop rollers 120*c* are halted with different timings in accordance with the skew amount of the sheet.

By this configuration, even when a sheet P is greatly skewed, it is possible to appropriately correct by halting the right and left halves with different timings. It is therefore possible to appropriately correct the skew of a sheet P irrespective of the differential conveyance distance.

Generally speaking, when conveyed from another apparatus in the upstream side, the skew of a sheet tends to be greater than when conveyed from own paper tray. It is therefore possible to appropriately correct the skew of a sheet P by making the skew correcting ability of the second correction control greater than the skew correcting ability of the first correction control.

The foregoing description has been presented on the basis of the image forming system according to the embodiments of the present invention. However, it is not intended to limit the present invention to the precise form described, and obviously many modifications and variations are possible within the scope of the invention. Also, the present invention can be considered to relate not only to the image forming system, but also to the first large volume paper feed apparatus, i. e., the paper feed apparatus itself which is located immediately upstream of the image forming apparatus. The first large volume paper feed apparatus as described in each of the above embodiments is not necessarily the paper feed apparatus located immediately upstream of the image forming apparatus; but applicable to a paper feed apparatus in the upstream side thereof. However, taking into consideration that the skew of a sheet is corrected for the purpose of inhibiting displacement of image formation, it is particularly effective to apply the present invention to the paper feed apparatus immediately upstream of the image forming apparatus.

What is claimed is:

1. A paper feed apparatus comprising:

a paper tray configured to store sheets;

a paper stop unit configured to transfer a sheet to an apparatus connected in the downstream side of said paper feed apparatus with a predetermined timing;

a first conveyance unit configured to convey a sheet fed from said paper tray to said paper stop unit;

a second conveyance unit configured to receive a sheet from an apparatus connected in the upstream side of said paper feed apparatus, and convey this paper to said paper stop unit; and a control unit configured to perform first correction control for controlling said first conveyance unit to correct the skew of a sheet by forming a loop of the sheet between said paper stop unit and said first conveyance unit, and second correction control for controlling said second conveyance unit to correct the skew of a sheet by forming a loop of the sheet between said paper stop unit and said second conveyance unit, wherein said control unit performs said first correction control and said second correction control in order that a skew correcting ability of said second correction control is greater than the skew correcting ability of said first correction control, wherein the skew correcting ability is adjusted by a conveyance linear speed of a sheet.

2. The paper feed apparatus of claim 1 wherein said control unit sets the conveyance linear speed of a sheet through said second conveyance unit for the second correction control slower than the conveyance linear speed of a sheet through said first conveyance unit for said first correction control.

3. The paper feed apparatus of claim 1 wherein said control unit sets the loop amount of a sheet for said second correction control greater than the loop amount of a sheet for said first correction control.

4. The paper feed apparatus of claim 1 wherein each of said first conveyance unit and said second conveyance unit comprising: a loop roller located in the upstream side of a paper stop roller which functions as said paper stop unit, and configured to form a loop between said loop roller and said paper stop roller; one or more conveyance roller located in the upstream side of said loop roller.

5. The paper feed apparatus of claim 4 wherein said one or more conveyance roller located in the upstream side of said loop roller is configured to switch between a pressure engaged state and a disengaged state, and wherein when forming a loop of a sheet with said loop roller, said control unit switches said one or more conveyance roller to the disengaged state.

6. The paper feed apparatus of claim 4 wherein said loop roller is separated into halves which are located respectively corresponding to the opposite edges of a sheet in the direction perpendicular to the transfer direction of the sheet, and wherein said control unit performs said second correction control in order that the halves of said loop roller are halted with different timings in accordance with the skew amount of the sheet.

7. An image forming system comprising;

a first paper feed apparatus configured to feed sheets;

a second paper feed apparatus coupled with said first paper feed apparatus in the upstream side thereof, and configured to feed sheets to said first paper feed apparatus; and an image forming apparatus coupled with said first paper feed apparatus in the downstream side thereof, and configured to form images on sheets, wherein said first paper feed apparatus comprising:

a paper tray configured to store sheets;

a paper stop unit configured to transfer a sheet to said image forming apparatus with a predetermined timing;

a first conveyance unit configured to convey a sheet fed from said paper tray to said paper stop unit;

a second conveyance unit configured to receive a sheet from said second paper feed apparatus, and convey this paper to said paper stop unit; and a control unit configured to perform first correction control for controlling said first conveyance unit to correct the skew of a sheet by forming a loop of the sheet between said paper stop unit and said first conveyance unit, and second correction control for controlling said second conveyance unit to correct the skew of a sheet by forming a loop of the sheet between said paper stop unit and said second conveyance unit, wherein said control unit performs said first correction control and said second correction control in order that a skew correcting ability of said second correction control is greater than the skew correcting ability of said first correction control, wherein the skew correcting ability is, adjusted by at least one of conveyance linear speed of a sheet and the loop amount of a sheet.

8. The image forming system of claim 7 wherein said image forming apparatus is provided with a paper stop unit configured to adjust the timing of transferring a sheet for forming an image on the sheet, and convey the sheet, and wherein said paper stop unit performs operation for adjust the timing of transferring a sheet in advance of feeding the sheet to said image forming apparatus.

* * * * *